US006722938B1

(12) United States Patent
Komatsu et al.

(10) Patent No.: US 6,722,938 B1
(45) Date of Patent: Apr. 20, 2004

(54) SHADOW MASK, PLATE MEMBER THEREFOR AND METHOD OF MANUFACTURING SHADOW MASK

(75) Inventors: Takayasu Komatsu, Tokyo-to (JP); Hiromitsu Ochiai, Tokyo-to (JP); Akira Makita, Tokyo-to (JP); Hirofumi Hideshima, Tokyo-to (JP); Takuya Ogio, Tokyo-to (JP); Toshimu Watanabe, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 381 days.

(21) Appl. No.: 09/655,191

(22) Filed: Sep. 5, 2000

(30) Foreign Application Priority Data

Sep. 6, 1999 (JP) ..... 11-251950

(51) Int. Cl.[7] ..... H01J 9/12; B26F 3/00
(52) U.S. Cl. ..... 445/47; 225/2
(58) Field of Search ..... 225/2, 96.5; 445/47; 216/12

(56) References Cited

U.S. PATENT DOCUMENTS 4,427,396 A * 1/1984 van den Berg ..... 445/47
4,846,747 A * 7/1989 Higashinakagawa et al. . 445/47
5,616,985 A * 4/1997 Hosotani ..... 313/403

* cited by examiner

*Primary Examiner*—Sandra O'Shea
*Assistant Examiner*—Peter Macchairolo
(74) *Attorney, Agent, or Firm*—Timothy J. Keefer; Wildman, Harrold, Allen & Dixon LLP

(57) ABSTRACT

A shadow mask is formed from a plate member comprising an outer frame portion, a body portion of a shadow mask having an outer peripheral line formed through an etching process and a plurality of connection portions through which the body portion of the shadow mask is supported by the outer frame portion. The shadow mask is formed from the plate member by removing the outer frame portion from the body portion of the shadow mask. In this process, a break portion is formed to the shadow mask by removing the outer frame portion so as to be recessed inward from the outer peripheral line of the shadow mask.

13 Claims, 7 Drawing Sheets

SHADOW MASK, PLATE MEMBER THEREFOR AND METHOD OF MANUFACTURING SHADOW MASK

CROSS REFERENCE TO RELATED APPLICATION

This application claims the priority of Japanese patent application Serial No. PP 251950 filed on Sep. 6, 1999.

BACKGROUND OF THE INVENTION

The present invention relates to a shadow mask for a Braun tube (cathode-ray tube), a plate member for the shadow mask and a method of manufacturing the shadow mask. More particularly, the present invention relates to a shadow mask having a structure capable of preventing the formation of foreign material, and preventing any foreign material that does form, from falling from the plate member and interfering with the manufacturing process.

Usually, a shadow mask is manufactured from an original metal plate material or member, hereinafter called a "plate member". The plate member is composed of a shadow mask body and an outer frame member to which the shadow mask body is supported through a plurality of connecting portions. The shadow mask body is formed, through an etching process, with an outer peripheral line penetrating through the plate member. Then, the outer frame member is removed through bending or pulling (tensioning). The outer peripheral line of the shadow mask is formed through etching, and plural connecting portions are formed intermittently as non-penetration portions. The shadow mask body is supported by the outer frame member of the plate member through such connecting portions.

The outer frame member is broken and then removed from the plate member by folding and bending the outer frame member or applying tension thereto, thus obtaining the shadow mask.

The shadow mask is then subjected to various processes, and thereafter, is mounted to a Braun tube.

Incidentally, in this specification the term of "outer peripheral line" is defined as a line of the extremely outer peripheral portion of the shadow mask, which is formed by the etching process, irrespective of a shape of the extremely outer peripheral portion.

Japanese Patent Publication No. SHO 63-888, Japanese Patent Laid-open Publication No. HEI 4-71138, Japanese Laid-open Patent Publication No. HEI 8-31317 and Japanese Laid-open Patent Publication No. HEI 11-73876, disclose methods of manufacturing a shadow mask by removing the shadow mask from a plate member to which a shadow mask body is formed. The conventional methods prevent deformation of an effective portion of the shadow mask and effectively remove the outer frame member by effecting a half-etching process to the connection portions so that the connection portions are easily broken to remove the outer frame.

However, in conventional shadow mask manufacturing methods, the connection portions include a convex (protruding) shape at a position outside the outer peripheral line of the shadow mask. Such a protruding portion may negatively affect processes performed on the shadow mask after the removing process of the outer frame member or portion.

For example, in a process of pressing the shadow mask to form a predetermined shape which fits a Braun tube, the protruding portion of the connection portion may contact a metallic mold of the press and fall as a foreign particle (e.g., a metal piece or tip), and if the shadow mask is mounted to the Braun tube while a foreign particle adheres to an etching hole of the shadow mask, the quality of the Braun tube will be degraded.

SUMMARY OF THE INVENTION

An object of the present invention is to eliminate defects or drawbacks encountered in the prior art mentioned above and to provide a shadow mask having a structure that, when the shadow mask is mounted to a Braun tube, foreign particles are either not formed, or are prevented from falling. A further object is to provide a plate member for such shadow mask and to provide a method of manufacturing the shadow mask.

These and other objects of the present invention can be achieved by providing, in one aspect, a shadow mask formed from a plate member comprising an outer frame portion, a body portion of a shadow mask having an outer peripheral line formed through an etching process and a plurality of connection portions through which the body portion of the shadow mask is supported by the outer frame portion, the shadow mask being formed by removing the outer frame portion from the body portion of the shadow mask, wherein a break portion is formed to the shadow mask by removing the outer frame so as to be recessed inward from the outer peripheral line of the shadow mask.

In preferred embodiments of this aspect, the break portion is formed by applying a half-etching process to a predetermined portion of the body portion of the shadow mask. The break portion is formed through one of breaking processes at least including a folding process, a tensioning process and a tearing process. The break portion has an end portion formed to be recessed inward from the outer peripheral line with a distance being set within a range from 10 to 100 $\mu$m.

According to this aspect of the present invention, since the break portion formed by removing the outer frame portion is concavely formed inside the outer peripheral line of the shadow mask, it is possible to prevent, in a predetermined process after the removing process, the break portion from being rubbed and fallen from the shadow mask as a foreign particle.

In addition, since the half-etched portion has a remaining thin thickness, even in a case of folding the outer frame portion to break the outer frame portion, it is hard to cause cracks, making it possible to prevent a foreign particle from being fallen.

Furthermore, since the break portion is concavely formed (recessed) inward with respect to the outer peripheral line, it is possible to increase the degree of freedom to select one of the methods of removing the outer frame portion, thereby effectively manufacturing the shadow mask.

Since the end portion of the break portion is recessed inward from the outer peripheral line so that the distance between the end portion of the break portion and the outer peripheral portion is set within a range from 10 to 100 $\mu$m, it is possible to prevent the metallic particle from being rubbed against another member and then fallen.

In another aspect of the present invention, there is provided a plate member for a shadow mask comprising:

- a shadow mask body having an outer peripheral line providing an outline thereof, the outer peripheral line being formed through an etching process;
- an outer frame portion for supporting the shadow mask body;

a plurality of connection portions through which the shadow mask body is supported by the outer frame portion; and a portion to be broken formed on a shadow mask side at a portion inside the outer peripheral line of the shadow mask body.

In a preferred embodiment of this aspect, the portion to be broken is arranged so as to be opposed to the connection portion. The portion to be broken has a predetermined length in a direction along the outer peripheral line, the predetermined length of the portion to be broken being substantially the same as that of the opposed connection portion in the direction along the outer peripheral line. The portion to be broken is subjected to a half-etching process. The portion to be broken is formed with an intermediate portion having a substantially concave shape.

The portion subjected to the half-etching process has a width in a direction orthogonal to the direction of the outer peripheral line, and a center line of the width is located inside the outer peripheral line so that a distance between the outer peripheral line and the center line is longer than 25 $\mu$m and not more than 100 $\mu$m.

The portion to be broken is a portion forming a break portion of the shadow mask from which the outer frame portion is removed.

According to another aspect of the present invention, since the portion to be broken, which is broken when removing the outer frame portion, is formed on a shadow mask side with respect to the connection portions and an inner side of the outer peripheral line of the shadow mask, the break portion is concavely formed on an inner side of the outer peripheral line of the shadow mask. As a result, it is possible to prevent, in a predetermined process after the removing process, the break portion from being rubbed against another member so as not to be fallen as foreign particle.

Furthermore, since the predetermined length of the portion to be broken is the same as that of the opposite connection portion in the outer peripheral line, the break caused by removing the outer frame portion occurs selectively just inside the connection portion, that is, an inner side of the shadow mask, so that it is possible to form the break portion on an inner side position with respect to the outer peripheral line of the obtained shadow mask.

In addition, the outer frame portion is selectively broken at the half etched portion so as to be removed from the material sheet. The center line of the width is located on the inner side of the outer peripheral line so that the distance between the outer peripheral line and the center line is longer than 25 $\mu$m and not more than 100 $\mu$m, so that even if the break portion is removed through one of the folding process, the tensioning (drawing) process and the tearing process, it is possible to form the break portion inside the outer peripheral line of the obtained shadow mask.

In a further aspect of the present invention, there is also, provided a method of manufacturing a shadow mask comprising the steps of:

preparing a plate member comprising a shadow mask body having an outer peripheral line formed through an etching process, an outer frame portion for supporting the shadow mask body, a plurality of connection portions through which the shadow mask body is supported by the outer frame portion, and a portion to be broken formed on a shadow mask side at a portion inside the outer peripheral line of the shadow mask body;

removing the outer frame portion from the plate member through one of the breaking processes at least including a folding process, a tensioning process and a tearing process which is applied to the portion to be broken.

In this aspect the plate member may be produced from a metallic thin plate by effecting an etching process thereto.

According to further aspect of the present invention, the outer frame portion of the plate member is removed therefrom through one of the folding process, the tensioning process and the tearing process, it is possible to easily manufacture the shadow mask capable of preventing the break portion from being rubbed against another member so as not to be fallen as a foreign particle.

The nature and further characteristic features of the present invention will be made more clear from the following descriptions made with reference to the accompanying drawings.

BRIEF DESCRIPTION OF THE DRAWINGS

In the accompanying drawings:

FIG. 4, including

FIG. 5, including

DESCRIPTION OF THE PREFERRED EMBODIMENTS

The preferred embodiments of the present invention will be described hereinafter with reference to the accompanying drawings.

Figure 1:
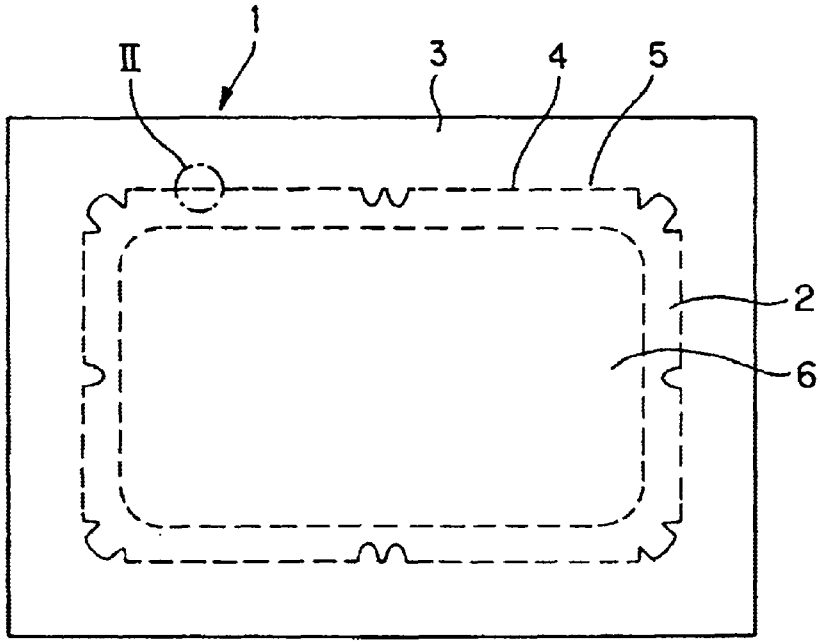
FIG. 1 is a plan view showing an example of a plate member for a shadow mask according to one embodiment of the present invention.
Figure 2:
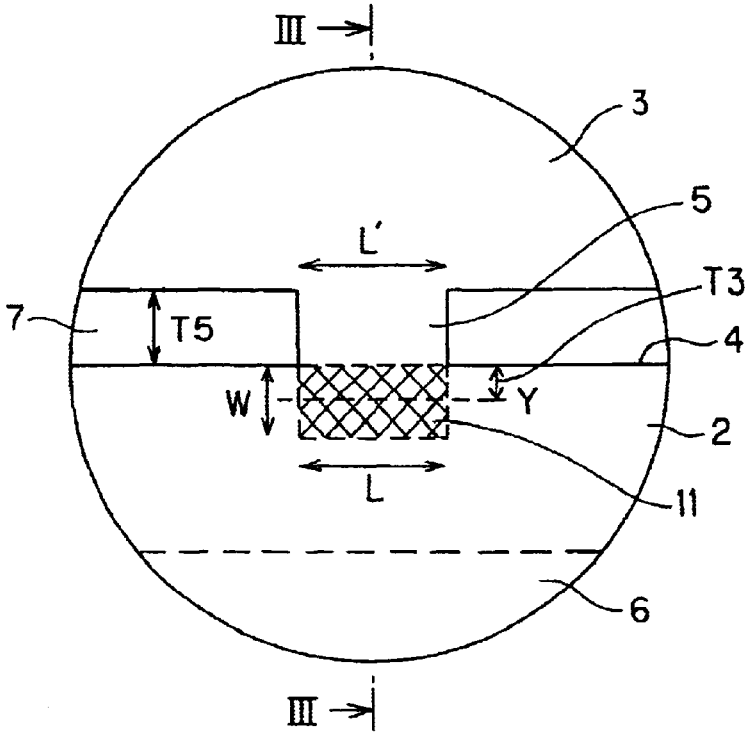
FIG. 2 is an illustration of an area II, in an enlarged scale, of FIG. 1.
Figure 3:
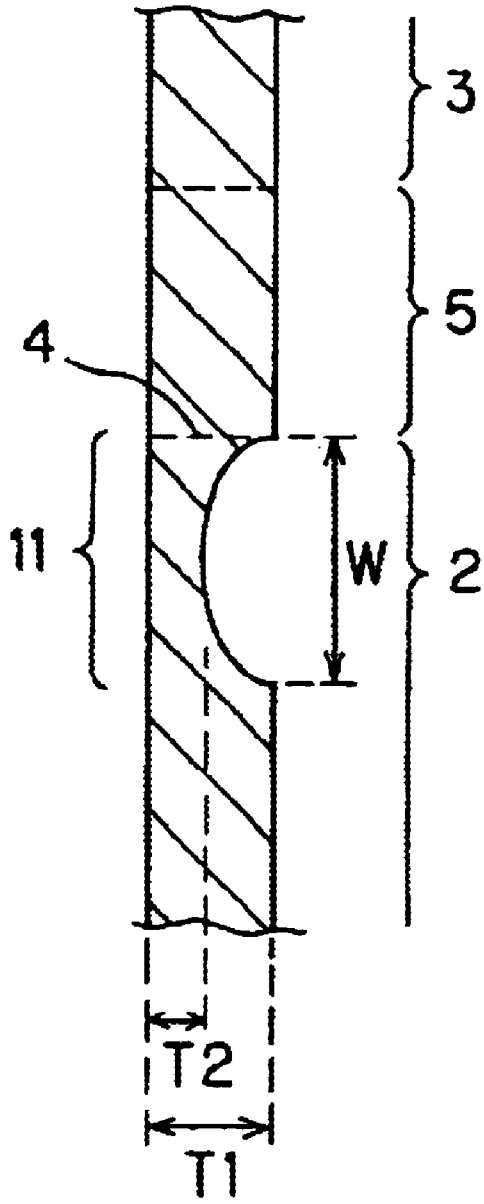
FIG. 3 is a sectional view taken along a line III—III of FIG. 2.

With reference to FIGS. 1 to 3, the cross hatched portion in FIG. 2 shows a portion to be broken 11, which in the current example is subjected to a half-etching process.

A shadow mask is formed from an original plate-like material or member 1, called herein a "plate member" formed of a thin metal plate member through an etching process. The plate member 1 for the shadow mask is, as shown in FIG. 1, composed of a shadow mask body 2 having an outer peripheral line 4, an outer frame portion 3 and a plurality of connection portions 5 through which the shadow mask 2 is supported to the outer frame portion 3.

The plate member 1 is provided with penetration portions 7 formed inside the shadow mask body 2, through which an electronic beam passes. The shadow mask is formed by removing the outer frame portion 3 from the plate member 1.

Inside the shadow mask body 2, a portion 6 having a plurality of slots (apertures) is formed.

Moreover, the shadow mask body 2 is provided at its peripheral portion with portions 11 to be broken as shown in FIG. 2. The portions 11 to be broken are provided so as to be opposite to the connection portions 5, respectively, with the same interval of the connection portions.

Next, the portion 11 to be broken is explained in detail.

Figure 6:
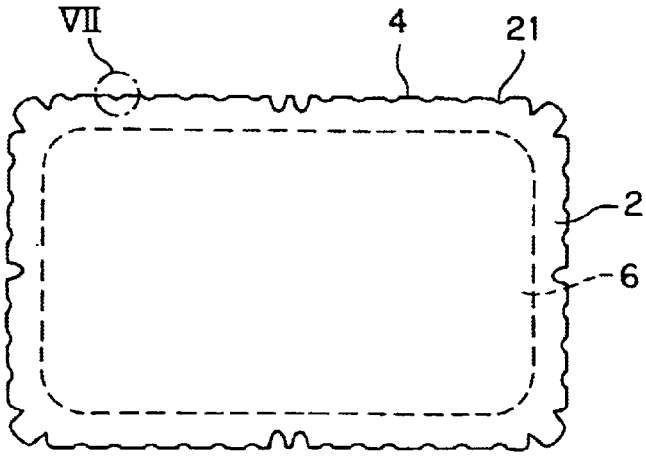
FIG. 6 is a plan view showing an example of the shadow mask according to the present invention.
Figure 7:
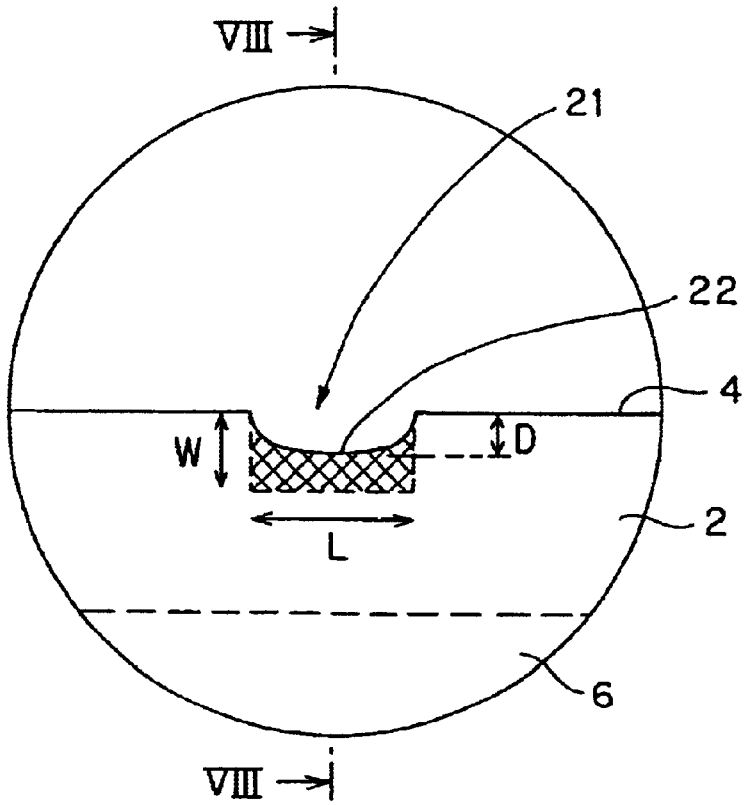
FIG. 7 is an illustration of an area VII, in an enlarged scale, of FIG. 6.

Referring to FIGS. 2, 6 and 7, the portion 11 to be broken of the material sheet 1 is a portion forming a break portion 21 of the shadow mask body 2 from which the corresponding outer frame portion 3 is removed. As shown in FIG. 2, the portion 11 to be broken is formed on an inner side of the outer peripheral line 4 of the shadow mask 2. Because the portion 11 to be broken is formed at this position of the shadow mask body 2, the break portion 21, when the corresponding outer frame portion 3 is removed from the shadow mask 2, is formed on the inner side of the outer peripheral line 4 of the shadow mask body 2 so as to have a substantially concave shape as a recess. As a result, in a process after the breaking process, there is no fear that the break portion 21 is rubbed against another member and then peeled off or becomes a foreign particle (metallic particle) and falls.

The portion 11 to be broken is able to be formed on the shadow mask body 2 by making thin a width of the portion 11 by a half-etching process, or by forming a variety of slits on the portion 11. Because the thus processed portion 11 to be broken has been weakened, when the outer frame portion 3 is removed from the plate member 1, the portions 11 to be broken are selectively broken.

In one example, the portion 11 to be broken, as shown in FIG. 3, is formed through a half-etching process with an intermediate portion which has a substantially concave shape. Therefore, the portion 11 to be broken, which is subjected to the half-etching process, is strong enough to hold while the plate member 1 is handled normally, but when the material sheet I is subjected to a folding, bending, or tensioning process in order to remove the outer frame portion 3, it is easy to selectively break the portion 11 of the plate member 1 through the concentration of stress on that portion 11.

It is desirable to selectively break the portion 11 when removing the outer frame portion 3 from the plate member 1. As shown in FIG. 2, the portion 11 has a predetermined length L in the outer peripheral line 4 as well as a length L' of the opposite connection portion 5 in the peripheral line 4. The portion 11 is located just on the inside of the opposite connection portion 5, that is, on the inner side of the shadow mask 2 itself, so that, after breaking, the break portion 21 (to remove the corresponding outer frame portion 3) is concavely formed as a recess on the inner side of the outer peripheral line 4 of the shadow mask 2.

Furthermore, both ends of the half-etching portion formed on the portion 11 (both ends of the portion 11 in the direction of the length L in FIG. 2) and both ends of the connection portion 5 (both ends of the connection portion 5 in the direction of the length L' in FIG. 2) are subjected to the half-etching process so as to be connected in such a way that it is possible to concavely form the break portion 21, when the corresponding outer frame portion 3 is removed from the shadow mask 2, on the inner side of the outer peripheral line 4 of the shadow mask 2.

Incidentally, if the length L of the portion 11 is smaller than the length L' of the opposite connection portion 5, portions of the plate member 1 (connection portions 5 thereof, except for the portion 11 to be broken) are broken so that an end portion of each remaining connection portion is convexly formed outside the outer peripheral line 4. Hence, it is difficult to solve the problems mentioned hereinbefore.

On the other hand, if the length L of the portion 11 to be broken is larger than the length L' of the opposite connection portion 5, the portion 11 is pulled by the connection portion 5, when the outer frame portion 3 is removed, so that an end portion of the break portion 21 is convexly formed as a protrusion on the outer side of the outer peripheral line 4. Hence it is difficult to overcome the problems mentioned hereinbefore.

In addition, the half-etching portion formed on the portion 11 has a width in a direction orthogonal to the direction of the length L. It is desirable to form the half-etching so that a center line Y of the width thereof is located on an inner side of the outer peripheral line 4 and a distance between the outer peripheral line 4 and the center line Y is longer than 25 $\mu$m and not more than 100 $\mu$m.

Although the break position to the portion 11 varies according to the manner of the process applied on the portion 11 to be broken, the break of the portion 11 occurs mostly at a portion in the vicinity of the center line Y of the half-etching portion formed on,the portion 11. Thus, because the half-etching portion is formed on the portion 11 to be broken so that the center line Y of the width of the portion 11 is located inside the outer peripheral line 4 and the distance between the outer peripheral line 4 and the center line Y is longer than 25 $\mu$m and not more than 100 $\mu$m, even if the end portion 22 of the break portion 21 which is formed after the portion 11 is broken is elongated, it is possible to prevent the end portion 22 of the break portion 21 from projecting outward with respect to the outer peripheral line 4.

Incidentally, in a case where the distance between the outer peripheral line 4 and the center line Y is greatly longer than 100 $\mu$m, although there is no fear that the end portion 22 of the break portion 21 convexly projects outward with respect to the outer peripheral line 4, the shadow masks are easily caught by each other at their recessed end portions 22, which are formed after the breaking processes, respectively, whereby there is the possibility of causing the scratches on the shadow masks or deformations thereof. Moreover, in the molding (forming) process, there is a fear of causing a wrinkle of the molding due to the recessed end portion 22.

In addition, when applying a tension process to the portion 11 to be broken formed by the half-etching process so as to break the portion 11, because the break portion 21 is stretched by the tension strength, it is preferred to set the distance between the outer peripheral line 4 and the center line Y to be within a range not more than 100 $\mu$m.

On the other hand, when folding the portion 11 to be broken formed by the half-etching process so as to break the portion 11, it is desirable to set a minimum thickness T2 of the half-etching portion formed on the portion 11 to be broken within a range from 20 to 40 $\mu$m. According to setting the minimum thickness T2 within the range from 20 to 40 $\mu$m, before removing the outer frame portion 3, it is possible to prevent the shadow mask 2 from easily being broken from the portion 11 so as to be separated therefrom, and furthermore, when removing the outer frame portion 3 from the shadow mask 2 by folding the portion 11, the occurrence of the crack to the break portion 21 is prevented.

Incidentally, in a case where the minimum thickness T2 is set less than 20 μm, there is the possibility that, before removing the outer frame portion 3, the shadow mask 2 is easily broken from the portion 11 and separated therefrom. On the other hand, in a case w here the minimum thickness T2 is set more than 40 μm, there is the possibility of, when removing the outer frame portion 3, frequently causing the crack to the break portion 21.

When applying a tension process to the portion 11 to be broken formed by the half-etching process so as to break the portion 11, it is preferred to set the minimum thickness T2 of the half-etching portion formed on the portion 11, which is close to the center line Y thereof, within a range from 15 to 30% of a width T1 of a non-etching portion of the material sheet 1. Depending on the setting of the minimum thickness T2, before removing the outer frame portion 3, it is possible to prevent the shadow mask 2 from being easily broken from the portion 11 and separated therefrom, and furthermore, when removing the outer frame portion 3 from the shadow mask 2 by tearing the portion 11, it is able to prevent the outer peripheral line 4 from being deformed.

In a case where the minimum thickness T2 is set less than 15% of the width T1 of the non-etching portion, there is a fear that, before removing the outer frame portion 3, the shadow mask 2 is easily broken from the portion 11 so as to be separated therefrom. On the other hand, in a case where the minimum thickness T2 is set more than 30% of the width T1 of the non-etching portion, it is hard, when removing the outer frame portion 3, to tear the outer frame portion 3 out of the shadow mask 2, so that there is the possibility of deforming the outer peripheral line 4 so as to have a substantially undulate shape.

Moreover, in a case of applying a tension process on the portion 11 to be broken formed by the half-etching process so as to break the portion 11, it is desirable that a total cross-sectional area of the half-etching portion formed on the portion 11 is small, making it possible to easily break the portion 11 to remove the outer frame portion 3.

However, in a case where the total cross-sectional area of the half-etching portion is too small, before removing the outer frame portion 3, the shadow mask 2 is easily broken from the portion 11 and separated therefrom. On the other hand, in a case where the total cross- sectional area of the half-etching portion is too large, it is necessary to apply a high breaking strength for breaking the portion 11, so that, when breaking the portion 11 to be broken, there is also a fear of deforming the outer peripheral line 4.

The preferable range of the total cross-sectional area of the half-etching portion varies according to the strength of the material of the portion 11 to be broken, carrier tensile force of base material at a time of manufacturing the shadow mask, so that the most suitable range of the total cross-sectional area of the half-etching portion is optionally set according to individual conditions or manners of the plate members for the shadow masks.

The other elements for the plate member 1 will be explained hereunder.

The connection portions 5 are provided for preventing the shadow mask body 2 from being separated from the plate member 1 when handling the plate member 1. The connection portions 5, each having the predetermined width (length L') in the peripheral line 4, are intermittently provided so as to cross the outer peripheral line 4 and to be opposite to the portions 11 to be broken, respectively. Therefore, a plurality of the connection portions 5 and the width L' thereof are individually set according to the specifications of the shadow masks as products.

Figure 9:
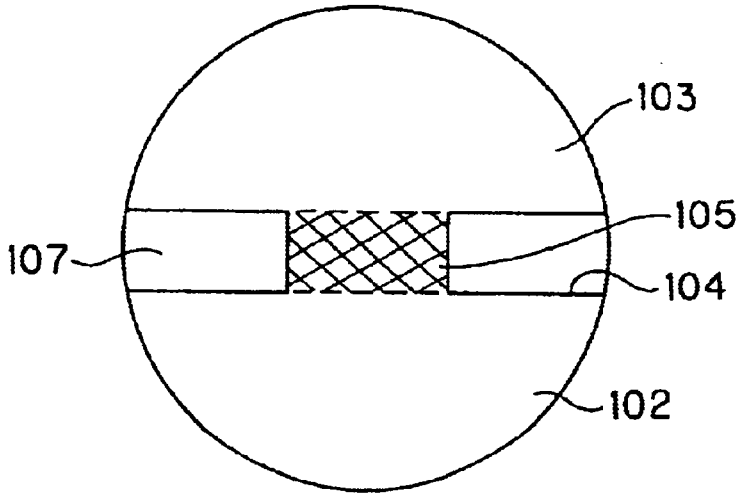
FIG. 9 PRIOR ART
FIG. 9 is a plan view showing a connection portion (a portion to be broken), in an enlarged scale, of a plate member for a conventional shadow mask.

With reference to FIG. 9 showing a conventional example, a connection portion 105 provided for a conventional plate member is located as a portion to be broken, so that, for example, an outer frame portion 103 can be removed from the plate member by folding the connection portion 105 subjected to the half-etching process and by tearing it.

However, in the present invention, the portion 11 to be broken, which is oppositely adjacent to the connection portion 5, is broken so that the outer frame portion 3 is removed from the plate member 1 to thereby obtain the shadow mask. Therefore, the structure of the plate member and the process of removing the outer frame portion from the plate member are clearly different from the structure of the conventional material sheet and the process of removing the outer frame portion of the conventional plate member. Furthermore, the outer peripheral line 4 is a line providing an outline of the shadow mask and the shape thereof is individually set according to the specification of the shadow mask as product. Usually, when forming the portion 6 having the slots or apertures on the shadow mask, the outer peripheral line 4 is formed through the etching process. A part of the outer peripheral line 4 is blocked with the connection portion 5 provided for supporting the shadow mask body 2. In the present invention, assuming that a virtual outer peripheral line extending the outer peripheral line 4 is provided, a positional relationship between the portion 11 to be broken and the outer peripheral line 4 are determined based on the relation to the virtual outer peripheral line.

The outer frame portion 3 is a portion outside the obtained shadow mask body 2 and capable of supporting the shadow mask body 2. On the outer frame portion 3, according to the removing processes, perforations or half-etching portions can be formed. The process applied to the outer frame portion 3 is not limited to predetermined ones such as the perforation process or the half-etching process, and it is possible to apply a suitable process to the outer frame portion 3 according to a kind of removing process for the shadow mask body 2. Although the present invention of the method us applicable to anyone of the shadow masks, it is particularly preferred to be applied to a case where there is a fear of portion 21 falling during the shadow mask working process after the removal of the outer frame portion 3.

Figure 4A:
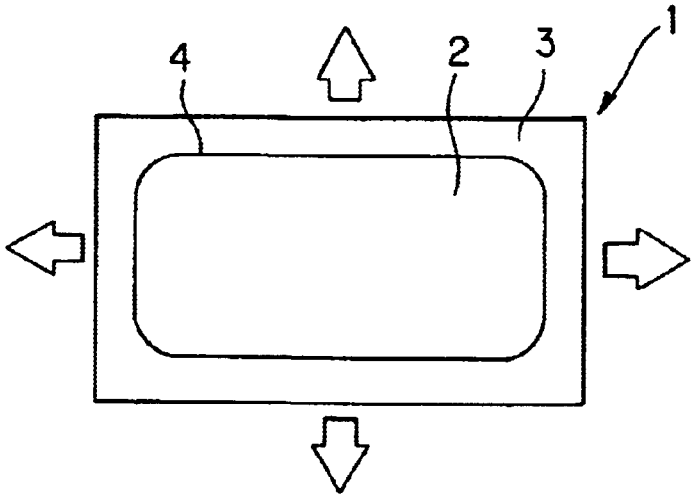
FIGS. 4A to 4C, is a view explaining processes of a method of manufacturing the shadow mask according to another embodiment of the present invention.
Figure 4B:
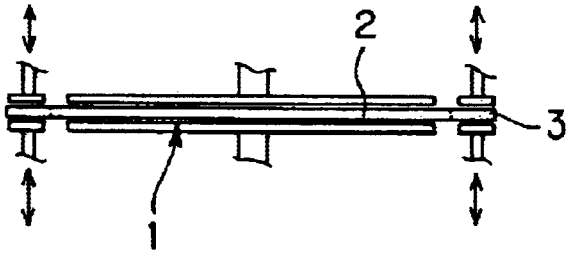
Figure 4C:
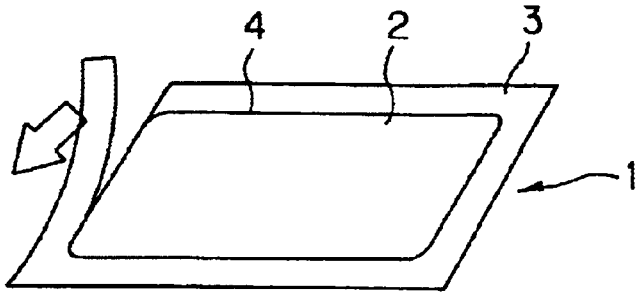

Then, a method of manufacturing the shadow mask is explained hereinafter with reference to FIGS. 4A to 4C showing a method of manufacturing the shadow mask 2 according to the present invention.

FIG. 4A shows a method of manufacturing the shadow mask by pulling the outer frame portion 3 from every side thereof so as to remove the outer frame portion 3 from the plate member 1. In this method, the portion 11 to be broken is subjected to a tensile stress so that the break (breaking or broken) shape of the portion 11 usually makes a specific shape corresponding to the tensile break.

FIG. 4B shows a method of manufacturing the shadow mask by folding the outer frame portion 3 upward and downward with respect to the plate member 1 so as to remove the outer frame portion 3 therefrom. In this method, the portion 11 to be broken is subjected to a bending stress so that the break shape of the portion 11 usually makes a specific shape corresponding to the bending (folding) break.

FIG. 4C shows a method of manufacturing the shadow mask by shearing the outer frame portion 3 so as to remove the outer frame portion 3 from the plate member 1. In this method, the portion 11 to be broken is subjected to a shearing stress so that the break shape of the portion 11 usually makes a specific shape corresponding to the shearing break.

Figure 5A:
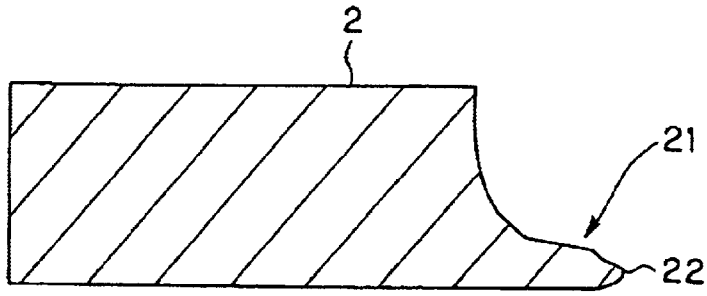
FIGS. 5A to 5C, is an enlarged sectional view showing shapes of portions to be broken of the plate member.
Figure 5B:
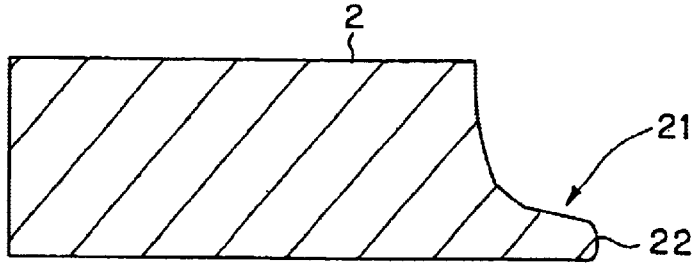
Figure 5C:
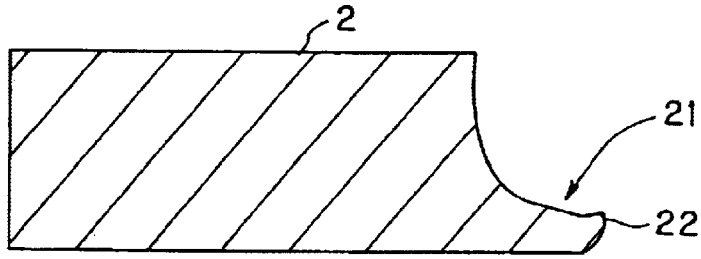

FIG. 5 is an enlarged sectional view showing an example of each break (breaking or broken) shape obtained by each process shown in FIGS. 4A to 4C. FIG. 5A shows the break shape of the portion 11 to be broken by the tensile process. FIG. 5B shows the break shape of the portion 11 to be broken by the folding process. FIG. 5C shows the break shape of the portion 11 to be broken by the tearing process.

In FIG. 5A, because of applying the tensile process on the portion 11 to be broken, the end portion 22 of the break portion 21 is elongated.

According to the present invention, the break portion 21 of any break shape may be formed to be recessed inward with respect to the outer peripheral line 4 of the shadow mask 2.

That is, in the method of manufacturing the shadow mask of the present invention, even in a case of using anyone of the breaking processes shown in FIGS. 4A to 4C, because the break portion 21 is concavely formed on the inner side of the outer peripheral line 4 of the shadow mask body 2, it is possible to easily manufacture a shadow mask which is capable of preventing a part of the break portion 21 from contacting another member so it does not peel off and fall as a foreign particle.

Figure 8:
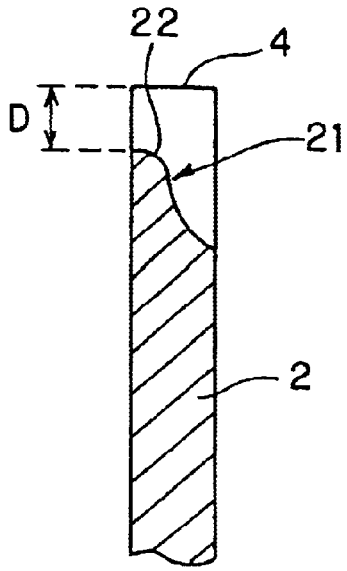
FIG. 8 is a sectional view taken along a line VIII—VIII of FIG. 7.

Finally, the shadow mask will be explained with reference to FIGS. 6 to 8.

The shadow mask according to the present invention is manufactured by removing the outer frame portion 3 from the plate member 1 which is provided with the shadow mask body 2 formed with the outer peripheral line 4 through the etching process and the outer frame portion 3 for supporting the shadow mask body 2 by the plural connection portions 5. The plate member 1 having the above structure is used, and a method of manufacturing the shadow mask by removing the outer frame portion 3, the illustrated method, described hereinbefore, is applied.

In a shadow mask obtained by the illustrated method, the break portion 21, which is broken when the corresponding outer frame portion 3 is removed from the shadow mask body 2, is concavely formed inside the outer peripheral line 4 of the shadow mask body 2.

Figure 10:
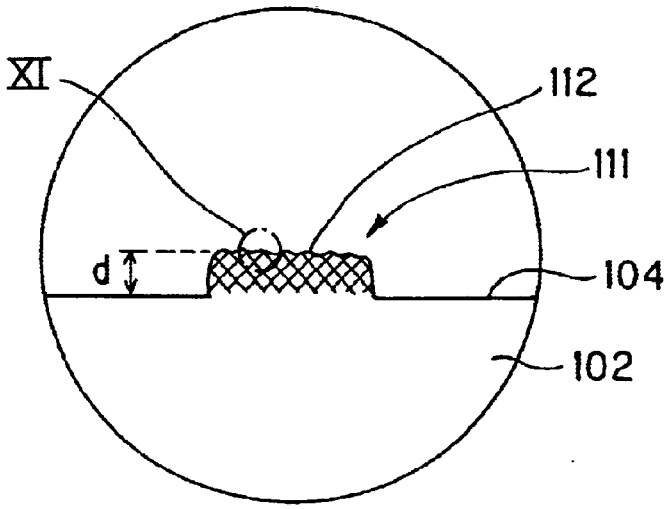
FIG. 10 PRIOR ART
FIG. 10 is a plan view showing an area X, from which the connection portion is broken, of the conventional shadow mask.

In contrast with the break portion 21 of the present invention, in a break portion 111 of the conventional shadow mask 102, as shown in FIG. 10, the end portion 112 is convexly formed on the outer side of the outer peripheral line 104. Thus, there is the possibility that the break portion 111 in the conventional shadow mask 102 can be rubbed off and fall as a foreign material or particle.

In the shadow mask of the present invention, however, because the break portion 21 is formed as a recess inside the outer peripheral line 4 of the shadow mask 2, there is no fear that a part of the break portion 21 will fall as a foreign material or particle.

Figure 11:
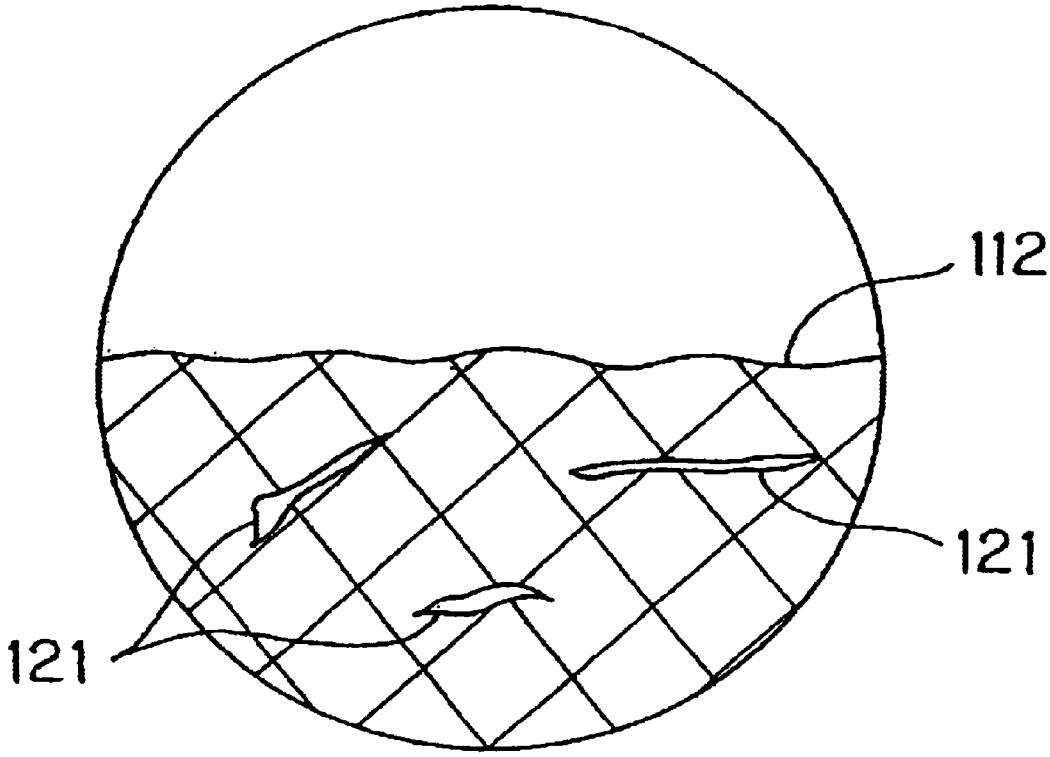
FIG. 11 PRIOR ART
FIG. 11 is a view showing an area XI, in an enlarged scale, of FIG. 10.

It is desirable that the break portion 21 is subjected to the half-etching process because when removing the outer frame portion from the conventional shadow mask by folding the portion to be broken, as shown in FIG. 11, fine cracks 121 are caused to the break portion 111. It is possible that the cracks 121 cause particles to fall from the shadow mask.

However, in the present invention, because the minimum thickness T2 of the half etching portion formed on the portion 11, which is close to the center line Y thereof, is set to an appropriate value, as shown in FIG. 2, the break stress is concentrated on the portion 11 to be broken, which is subjected to the half-etching process to have a thin thickness, so that the break portion 21 is formed on the portion 11. As a result, the cracks will not occur in the break portion 21, so that, during the predetermined process for obtaining the shadow mask 2, there is no fear that a part of the break portion 21 will rub against another member and fall as a foreign particle.

In order to prevent the metallic mold from rubbing against the break portion 21 so as to prevent the occurrence of the foreign particle, it is preferable that the end portion 22 of the break portion 21 is formed inward with respect to the outer peripheral line 4 of the shadow mask 2 so that a distance between the end portion 22 of the break portion 21 and the outer peripheral line 4 is set 10 $\mu$m or more.

In a case where the depth of the recessed break portion 21, that is, the distance between the outer peripheral line 4 and the end portion 22 of the break portion 21 Y is less than 10 $\mu$m, during the working process of the shadow mask 2 after the breaking process, there is the possibility that the metallic mold or the like will rub against the break portion 21 and cause the foreign particle. On the other hand, when the depth of the end portion 22 of the recessed break portion 21 is set to 100 $\mu$m or more, there is a fear of causing a wrinkle of the molding around the break portion 21 while working with the shadow mask 2 after the breaking process, so it is preferable that the depth of the end portion 22 of the break portion 21 be set to 100 $\mu$m or less.

According to the shadow mask of the present invention, the break portion 21 takes any one of the break shapes corresponding to the bending break, the tensile break and the tearing break. Each of the break shapes is obtained by using any of the methods shown in FIG. 4, and the break portion 21 is formed inside the outer peripheral line 4 of the shadow mask body 2. It is therefore possible to increase the degree of freedom to select one of the methods of removing the outer frame portion 3, thereby making the manufacture of the shadow mask efficient.

Particularly, it is effective to use the bending (folding) break method described in the Japanese Patent Laid-open Publication No. HEI 4-71138 which is capable of processing a plurality of plate members at once, but, owing to the bending process, causes cracks easily to the break portion. Therefore, in the molding process of the shadow mask, the metallic mold used by the molding process is rubbed against the break portion so that, due to the cracks, the metallic particles are easily fallen from the shadow mask. However, in the present invention, since the break portion 21 is concavely formed and is subjected to the half-etching process so that the remaining thickness thereof becomes thin, it is possible to control the occurrence of the crack and to prevent the break portion 21 from contacting another member such as the metallic mold or the like and also prevent the metallic particle from occurring. Therefore, in the present invention, it is possible to select the breaking method by using the bending (folding) process, which is disclosed, for example, in the Japanese Patent Laid-open Publication No. HEI 4-71138 as an effective method.

Examples carried out in connection with the embodiment of the present invention will be described hereunder to explain the present invention more concretely.

FIRST EXAMPLE 1

At first, a metallic thin plate made of an invar material with a thickness of 120 $\mu$m was prepared. The metallic thin plate was then subjected to an etching process so that a plate member related to the present invention was produced. The plate member 1 was formed with the shadow mask body 2 having the outer peripheral line 4, the portion 6 with the slots and the penetration portions 7, the outer frame portion 3 and the connect portions 5.

Moreover, the plate member 1 was formed with the portion 11 to be broken and the dimensions around the portion 11 were determined such that a length L' of the connection portion 5 is 10 mm, a length L of the half-etching portion as the portion 11 to be broken is 10 mm, a width W thereof is 125 μm, a minimum thickness T2 thereof is 35 μm and a width T5 of the penetration portion 7 of the outer peripheral line 4 of the shadow mask 2 is 400 μm.

The material sheet 1 was then subjected to the bending break process disclosed in the Japanese Patent Laid-open Publication No. HEI 4-71138, which is similar to the break method shown in FIG. 4B, so that the outer frame portion 3 was removed from the plate member 1 so as to obtain the remaining body portion as the shadow mask 2.

The thus obtained shadow mask, as shown in FIG. 7, was provided with the break portion 21 so as to be recessed inward with respect to the outer peripheral line 4 of the shadow mask. Then, the depth of the recessed break portion 21, that is, the length D between the outer peripheral line 4 and the end portion 22 of the break portion 21 was set to 27 μm.

Next, another metallic thin plate made of an invar material with a thickness of 120 μm was prepared. The metallic thin plate was then subjected to an etching process so that a conventional type of plate member was produced. The conventional material sheet was formed with the shadow mask (shadow mask body) 102 having the outer peripheral line 104, the portion 106 with the slots and the penetration portions 107, the outer frame portion 103 and the connect portions 105.

Moreover, the plate member was provided with the portion 111 to be broken and the dimensions around the portion 111 to be broken were determined such that a length L' of the connection portion 105 is 10 mm, a minimum thickness T2 thereof is 80 μm and a width T5 thereof, that is, a width of the penetration portion 107 of the outer peripheral line 104 of the shadow mask body 2 is 200 μm.

The thus obtained material sheet was then subjected to the bending break process disclosed in the Japanese Patent Laid-open publication No. HEI 4-71138, which is similar to the break method shown in FIG. 4B, so that the outer frame portion 103 was removed from the plate member to obtain the remaining body portion as the shadow mask 102.

The thus obtained conventional shadow mask 102, as shown in FIG. 10, was formed with the break portion 111 which is convexly formed outward with respect to the outer peripheral line 104 of the shadow mask 102. At this time, the depth of the convexly break portion 111, that is, the length d between the outer peripheral line 104 and the end portion 112 of the break portion 111 was set to 80 μm.

These end portions and their vicinities of the obtained shadow masks were observed with an electron microscope by the inventors, and it was confirmed that, in the shadow mask of the present invention, the ratio of occurrences of cracks was extremely reduced as compared with the conventional shadow mask 102.

When comparing the conventional shadow mask 102 with the shadow mask of the present invention through butting process on the mold platen made of steel, the outer end portion 112 of the break portion 111 of the conventional shadow mask 102 was deformed, and on the other hand, it was confirmed that the shadow mask of the present invention was not deformed and the break portion 21 was not contacted to the mold platen.

SECOND EXAMPLE 2

At first, a metallic thin plate made of an invar material with a thickness of 120 μm was prepared. The metallic thin plate was then subjected to an etching process so that a plate member related to the present invention is produced. The material sheet 1 was formed with the shadow mask body 2 having the outer peripheral line 4, the portion 6 with the slots and the penetration portions 7, the outer frame portion 3 and the connect portions 5.

Moreover, the material sheet 1 was provided with the portion 11 to be broken and the dimensions around the portion 11 were determined such that a length L' of the connection portion 5 is 10 mm, a length L of the half etching portion as the portion 11 to be broken is 10 mm, a width W thereof is 115 μm, a length T3 between the outer peripheral line 4 and the center line Y of the half-etching portion is 30 μm, a minimum thickness T2 of the half-etching portion is 28 μm and a width T5 of the penetration portion 7 of the outer peripheral line 4 is 400 μm.

The material sheet 1 was then subjected to the tearing break process shown in FIG. 4C, so that the outer frame portion 3 was removed from the plate member 1 so as to obtain the remaining body portion as the shadow mask.

When tearing the outer frame portion 3, while the shadow mask body 2 was held from its upper side by a holding plate so as to secure the shadow mask body 2, only the outer frame portion 3 was pulled obliquely upward towards the outside of the shadow mask body 2 so that the portion 11 to be broken 11 was broken and the outer frame portion 3 was removed from the shadow mask body 2.

The thus obtained shadow mask, as shown in FIG. 7, was formed with the break portion 21 to be recessed inward with respect to the outer peripheral line 4 of the shadow mask 2. Then, the concave length D between the outer peripheral line 4 and the end portion 22 of the break portion 21 was set to 28 μm. Next, another metallic thin plate made of an invar material with a thickness of 120 μm was prepared. The metallic thin plate was then subjected to an etching process so as to produce a plate member for comparison. The plate member for comparison was formed with the shadow mask 2 having the outer peripheral line 4, the portion 6 with the slots and the penetration portions 7, the outer frame portion 3 and the connect portions 5, similar to the planner member 1.

Moreover, the plate member was formed with the portion 11 to be broken and the dimensions around the portion to be broken were determined such that a length L' of the connection portion 5 is 10 mm, a length L of the half-etching portion as the portion 11 is 10 mm, a width W thereof is 100 μm, a length T3 between the outer peripheral line 4 and the center line Y of the half-etching portion is 30 μm, a minimum width T2 of the half-etching portion is 50 μm and a width T5 of the penetration portion 7 of the outer peripheral line 4 is 400 μm.

The plate member for comparison was then subjected to the tearing break process shown in FIG. 4C so as to remove the outer frame portion 3 from the plate member 1 to thereby obtain the remaining body portion as the shadow mask.

When tearing the outer frame portion 3, while the shadow mask body 2 was held from its upper side by a holding plate so as to secure the shadow mask body 2, only the outer frame portion 3 was pulled obliquely upward towards the outside of the shadow mask body 2 so that the portion 11 to be broken 11 was broken and the outer frame portion 3 was removed from the shadow mask 2.

The thus obtained shadow mask 2 for comparison was formed with the break portion 21 recessed inward with respect to the outer peripheral line 4 of the shadow mask 2.

Then, the concave length D between the outer peripheral line 4 and the end portion 22 of the break portion 21 was set to 40 μm, but a part of the outer peripheral line 4 was deformed to have an undulate shape.

THIRD EXAMPLE 3

At first, a metallic thin plate made of an invar material with a thickness of 120 μm was prepared. The metallic thin plate was then subjected to an etching process so that a plate member related to the present invention was produced. The plate member sheet 1 is formed with the shadow mask body 2 having the outer peripheral line 4, the portion 6 with the slots and the penetration portions 7, the outer frame portion 3 and the connect portions 5.

Moreover, the plate member 1 was formed with the portion 11 to be broken and the dimensions around the portion 11 were determined such that a length L' of the connection portion 5 is 10 mm, a length L of the half-etching portion as the portion 11 is 10 mm, a width W thereof is 115 μm, a length T3 between the outer peripheral line 4 and the center line Y of the half-etching portion is 30 μm, a minimum width T2 of the half-etching portion is 28 μm and a width T5 of the penetration portion 7 of the outer peripheral line 4 is 400 μm.

The material sheet 1 was subjected to the tensile break process shown in FIG. 4A, so that the outer frame portion 3 was removed from the material sheet 1 to obtain the remaining body portion as the shadow mask.

When pulling the outer frame portion 3, while both surfaces of the shadow mask body 2 were clamped by a stationary plate so as to secure the shadow mask body 2, only the outer frame portion 3 is pulled horizontally towards the outside of the shadow mask body 2 so that the portion 11 to be broken 11 was broken and the outer frame portion 3 was removed from the shadow mask body 2.

The thus obtained shadow mask, as shown in FIG. 7, was formed with the break portion 21 so as to be recessed inward with respect to the outer peripheral line 4 of the shadow mask body 2. Then; the concave length D between the outer peripheral line 4 and the end portion 22 of the break portion 21 was set to 20 μm. The reason that the concave length D is smaller than that of the first and second examples is that, as shown in FIG. 5A, the end portion 22 of the break portion 21 is elongated.

Further, it is to be noted that the present invention is not limited to the described embodiments or examples and many other changes and modifications may be made without departing from the scopes of the appended claims.

What is claimed is:

1. A shadow mask formed from a plate member comprising an outer frame portion, a body portion of a shadow mask having an outer peripheral line formed through an etching process and a plurality of connection portions through which the body portion of the shadow mask is supported by the outer frame portion, the shadow mask being formed by removing the outer frame portion from the body portion of the shadow mask, wherein a break portion is formed to the shadow mask by removing the outer frame so as to be recessed inward from the outer peripheral line of the shadow mask.

2. A shadow mask according to claim 1, wherein said break portion is formed by applying a half-etching process to a predetermined portion of the body portion of the shadow mask.

3. A shadow mask according to claim 1, wherein said break portion is formed through one of breaking processes at least including a folding process, a tensioning process and a tearing process.

4. A shadow mask according to claim 1, wherein said break portion has an end portion formed to be recessed inward from the outer peripheral line with a distance being set within a range from 10 to 100 μm.

5. A plate member for a shadow mask comprising:

a shadow mask having an outer peripheral line providing an outline thereof, said outer peripheral line being formed through an etching process;

an outer frame portion for supporting the shadow mask;

a plurality of connection portions through which the shadow mask is supported by the outer frame portion; and a portion to be broken formed on a shadow mask side at a portion inside the outer peripheral line of the shadow mask.

6. A plate member according to claim 5, wherein said portion to be broken is arranged so as to be opposed to the connection portion.

7. A plate member according to claim 6, wherein said portion to be broken has a predetermined length in a direction along the outer peripheral line, said predetermined length of the portion to be broken being substantially the same as that of the opposed connection portion in the direction along the outer peripheral line.

8. A plate member according to claim 5, wherein said portion to be broken is subjected to a half-etching process.

9. A plate member according to claim 8, wherein said portion to be broken is formed with an intermediate portion having a substantially concave shape.

10. A plate member according to claim 8, wherein said portion subjected to the half-etching process has a width in a direction orthogonal to the direction of the outer peripheral line, and a center line of the width is located inside the outer peripheral line so that a distance between the outer peripheral line and the center line is longer than 25 μm and not more than 100 μm.

11. A plate member according to claim 5, wherein said portion to be broken is a portion forming a break portion of the shadow mask from which the outer frame portion is removed.

12. A method of manufacturing a shadow mask comprising the steps of:

preparing a plate member comprising a shadow mask having an outer peripheral line formed through an etching process, an outer frame portion for supporting the shadow mask body, a plurality of connection portions through which the shadow mask is supported by the outer frame portion, and a portion to be broken formed on a shadow mask side at a portion inside the outer peripheral line of the shadow mask;

removing the outer frame portion from the plate member through applying a breaking process to the portion to be broken, wherein the breaking process includes at least one of a folding process, a tensioning process and a tearing process.

13. A method of manufacturing a shadow mask according to claim 12, wherein said plate member is produced from a metallic thin plate by effecting an etching process thereto.

* * * * *